United States Patent [19]

Logan

[11] 4,073,258

[45] Feb. 14, 1978

[54] LATERAL MANEUVERING CONTROL FOR WATER-JET PROPULSION SYSTEMS

[75] Inventor: James H. Logan, Bellevue, Wash.

[73] Assignee: The Boeing Company, Seattle, Wash.

[21] Appl. No.: 785,433

[22] Filed: Apr. 7, 1977

[51] Int. Cl.[2] ..... B63H 11/10

[52] U.S. Cl. ..... 115/12 R; 115/37; 114/151

[58] Field of Search ..... 114/144 R, 144 E, 146, 114/150, 151, 162; 115/11, 12 R, 12 A, 37, 400

[56] References Cited

U.S. PATENT DOCUMENTS

| | | | |
|---|---|---|---|
| 3,143,995 | 8/1964 | Koppen | 115/37 |
| 3,198,158 | 8/1965 | Winter | 114/151 |
| 3,412,705 | 11/1968 | Nesson | 115/12 R |
| 3,675,611 | 7/1972 | Glass | 114/151 |
| 3,827,389 | 8/1974 | Kureth | 115/12 R |
| 3,942,464 | 3/1976 | Schoell | 114/151 |
| 3,982,494 | 9/1976 | Posti | 115/12 R |

*Primary Examiner*—Trygve M. Blix
*Assistant Examiner*—D. W. Keen
*Attorney, Agent, or Firm*—Thomas H. Murray

[57] ABSTRACT

A control system is provided for water-jet propulsion systems for watercraft which provides for lateral maneuvering of the craft, as in docking operations. Water-jet propulsion systems, such as are used on hydrofoil craft, have two normally-parallel jets directed rearwardly of the craft, with individual means for reversing each jet. The angular direction of the jets is controlled by deflectors for use in steering the craft. In accordance with the invention, lateral movement of the craft is effected by moving the jets oppositely into divergent angular positions and simultaneously reversing the direction of one of the jets. This results in a lateral component of movement with a controllable rate and direction of yaw determined by the angles of the jets.

8 Claims, 9 Drawing Figures

FIG. 1
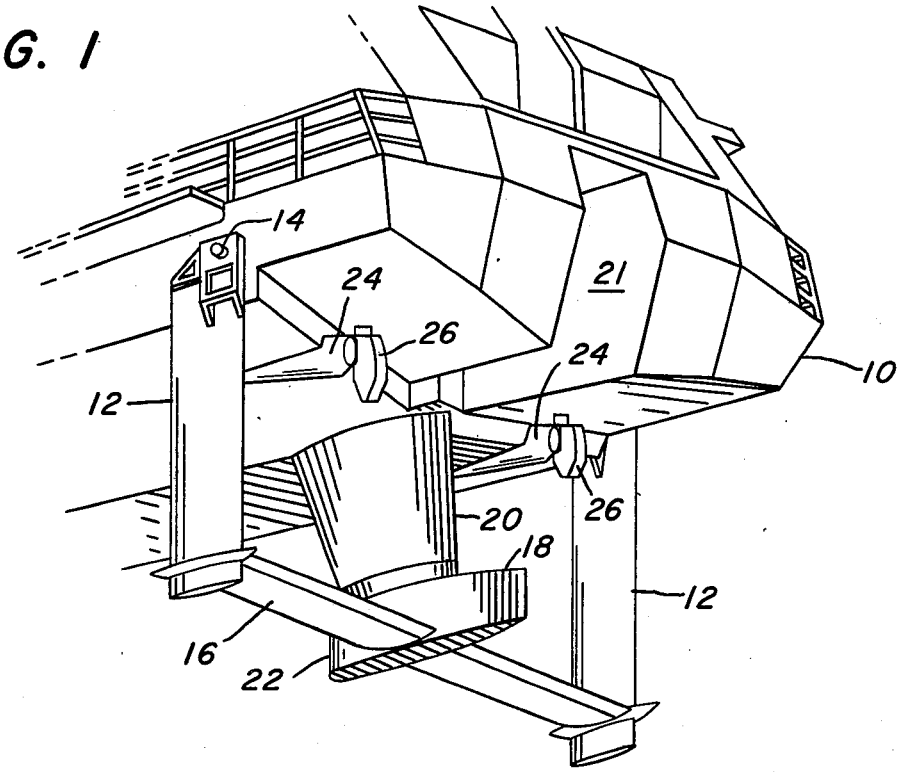
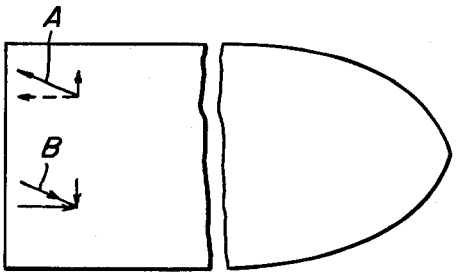
FIG. 2
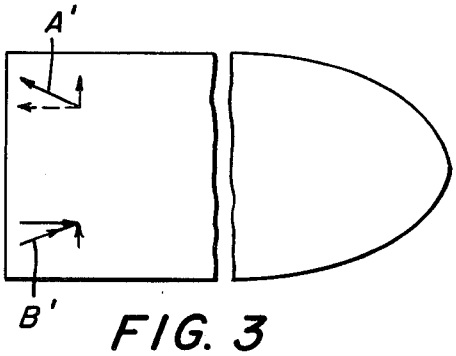
FIG. 3
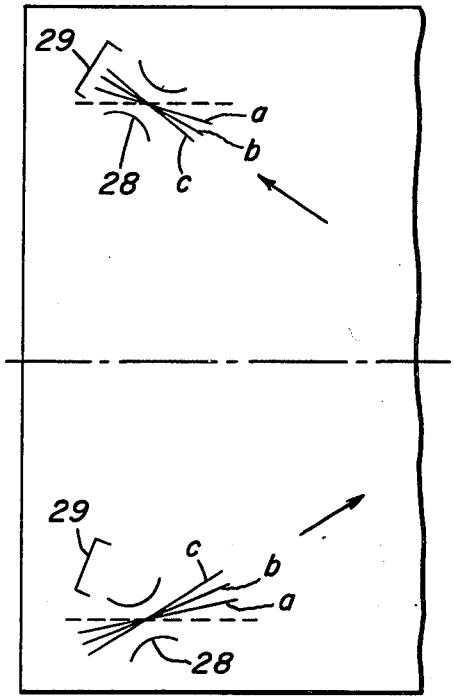
FIG. 4

FIG. 5
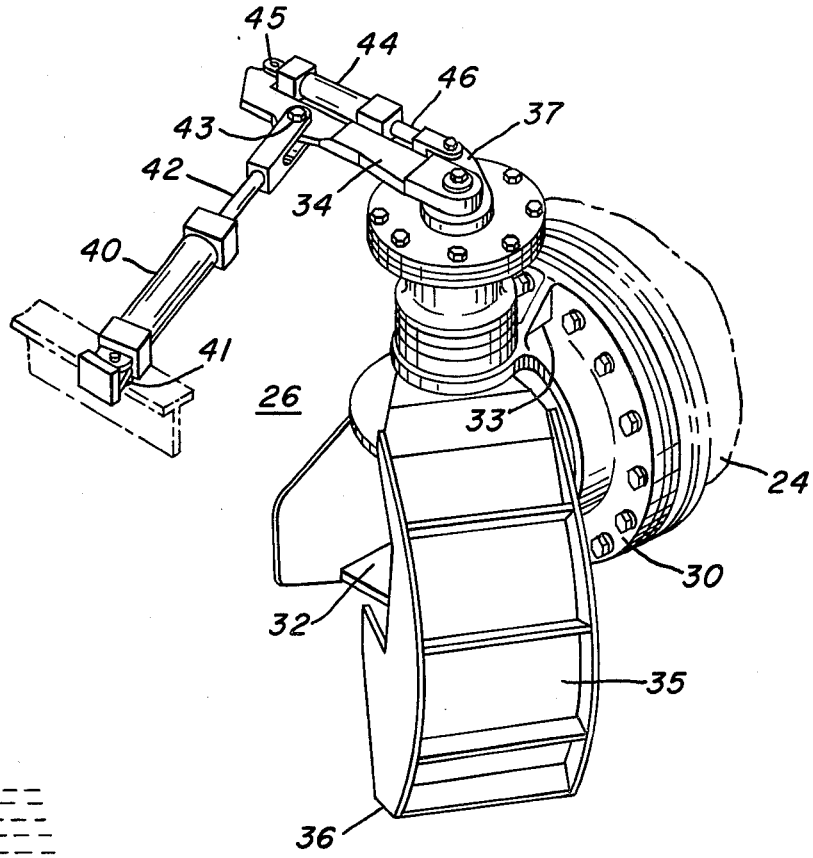
FIG. 6
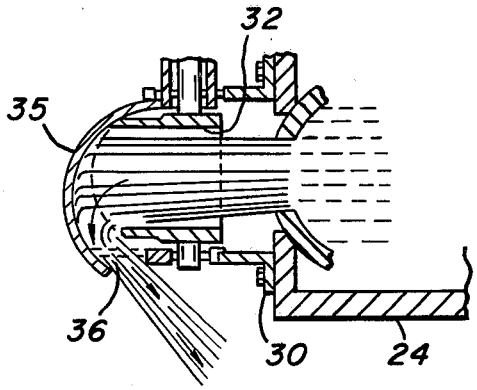
FIG. 8
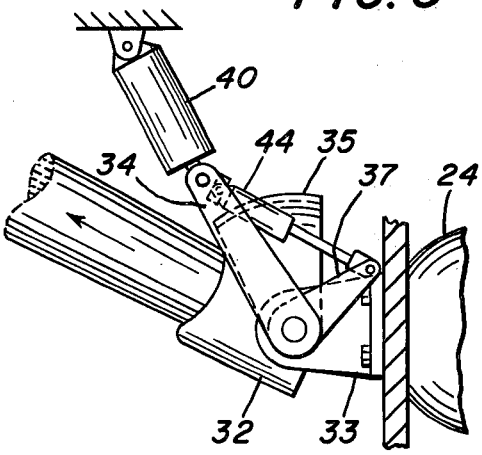
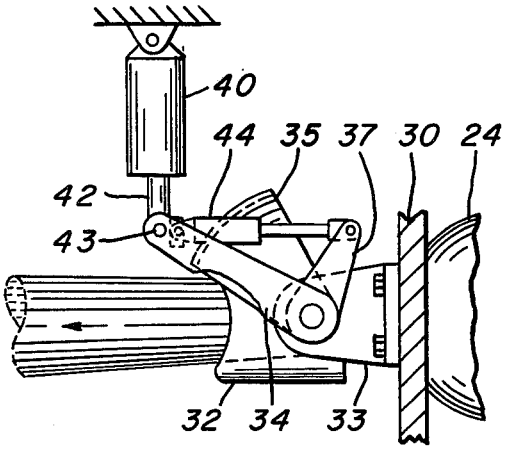
FIG. 7

LATERAL MANEUVERING CONTROL FOR WATER-JET PROPULSION SYSTEMS

BACKGROUND OF THE INVENTION

The present invention relates to water-jet propulsion systems for watercraft, and more particularly to a control system for effecting and controlling lateral movement of the craft.

The invention is particularly suitable for propulsion systems for hydrofoil craft, although its usefulness is not necessarily limited to such craft and it may be used in any water-jet propulsion system for watercraft of any type. Hydrofoil craft have a hull supported on struts which have foil systems at their lower ends. When such a craft is driven at sufficiently high speed, the submerged foils develop lift and support the hull above the water surface. Any suitable type of propulsion system can, of course, be used for these craft but water-jet propulsion systems are frequently used. In such a system, two jets are disposed on opposite sides of the center line of the craft. A water intake is provided in or on one of the struts which takes the water under ram pressure due to the forward movement of the craft through the water. Water entering through the intake divides into two streams and is directed to two pumps which accelerate the water and discharge it rearwardly in two high velocity jets, resulting in forwardlydirected reaction forces which propel the craft. A relatively simple system is thus provided which is capable of sustaining the desired high speed during foil-borne operation. At low speeds, such as when moving toward or away from a dock, the speed of the craft is such that the foils lose lift and the craft settles onto the water and operates in the hull-borne mode. The jet propulsion system functions in the same manner as at other times but at reduced speed of the pumps.

In normal operation, in either the foil-borne or hull-borne mode, the craft is steered by means of a helm which operates the rudder and control surfaces of the craft through a suitable control system. In addition, the two jets are used for sterring, at least in the hull-borne mode, either to assist the rudder and control surface action or as the primary steering means. For this purpose, the jets are provided with angularlymovable deflectors which control the direction of the jets. The deflectors are controlled from the helm in such a manner that the jets are maintained in parallel relation and can be simultaneously moved angularly to effect steering of the craft. In addition, a thrust reverser bucket is provided for each jet which can be moved into position to deflect the jet stream into a forward direction and thus reverse the direction of the thrust.

As mentioned above, when a hydrofoil or other craft is maneuvering to or away from a dock at the beginning or end of a trip, or in other similar situations, it operates in the hull-borne mode at relatively low speed. Lateral movement of the craft is frequently required under these conditions, with or without some amount of yaw, to bring the craft into the desired position. Yawing can be accomplished by reversing one of the jets but little lateral movement of the craft can be produced in this way. Bow thrusters have frequently been provided, therefore, for use during hull-borne maneuvering. Such a device consists of a propeller on a transverse shaft in the bow of the craft to provide lateral thrust. Such a bow thruster may be driven hydraulically from the main propulsion system, which limits the power available since maneuvering of this kind is usually done at idling speed or at relatively low speed, and the maximum diameter of a bow thruster propeller is limited by the relatively shallow draft of hydrofoil craft at the bow. The maximum thrust available for lateral maneuvering by means of a bow thruster is, therefore, quite limited. These devices provide a certain amount of low speed maneuvering ability but there are many conditions of wind velocity and direction, and of adverse currents, in which they have insufficient thrust, and in general the maneuverability obtainable by the use of bow thrusters is not satisfactory.

SUMMARY OF THE INVENTION

In accordance with the present invention, the use of bow thrusters is eliminated and lateral movement of the craft is effected and controlled by use of the propulsion jets alone.

For this purpose, a control system is provided which permits operation of the jets in the usual manner under control of the helm during normal operation. For low speed maneuvering, as in docking operations as discussed above, the system provides for removing the jets from control by the helm and using them for lateral maneuvering. As previously mentioned, each jet is normally provided with an angularly-movable deflector through which the jet passes to control its direction, as well as an individually-controlled reverser bucket. In accordance with the invention, lateral movement is effected by moving the deflectors in opposite directions such that the jets are splayed, or moved to divergent angular positions, which are preferably preset positions at equal angles on opposite sides of the center line of the craft. At the same time, the reverser bucket of one of the jets is operated to reverse the jet thrust. The effect of thus diverging the angular directions of the jets, together with reversing one of them, is to produce a lateral component of movement of the craft which can be easily and accurately controlled. The direction and, if desired, the amount of yaw can be controlled by adjusting the angle of the jets or by setting them to one of a number of preselected angular positions. This system results in a greater degree of maneuverability than could be attained by any available bow thruster system and provides sufficient lateral thrust to maneuver the craft as desired in any wind or sea conditions.

BRIEF DESCRIPTION OF THE DRAWINGS

The invention will be more fully understood from the following detailed description, taken in connection with the accompanying drawings, in which:

FIG. 1 is a perspective view of the stern portion of a hydrofoil craft having a water-jet propulsion system;

FIGS. 2 and 3 are diagrams illustrating the forces involved in lateral maneuvering of the craft;

FIG. 4 is a diagram further illustrating the principle of the present invention;

FIG. 5 is a perspective view of the deflector and thrust reverser assembly associated with each of the water jets;

FIG. 6 is a somewhat diagrammatic longitudinal sectional view of a deflector and thrust reverser in the reversed position;

FIGS. 7 and 8 are somewhat diagrammatic plan views of the deflector and thrust reverser in two different positions of forward operation.

DESCRIPTION OF THE PREFERRED EMBODIMENT

Figure 9:
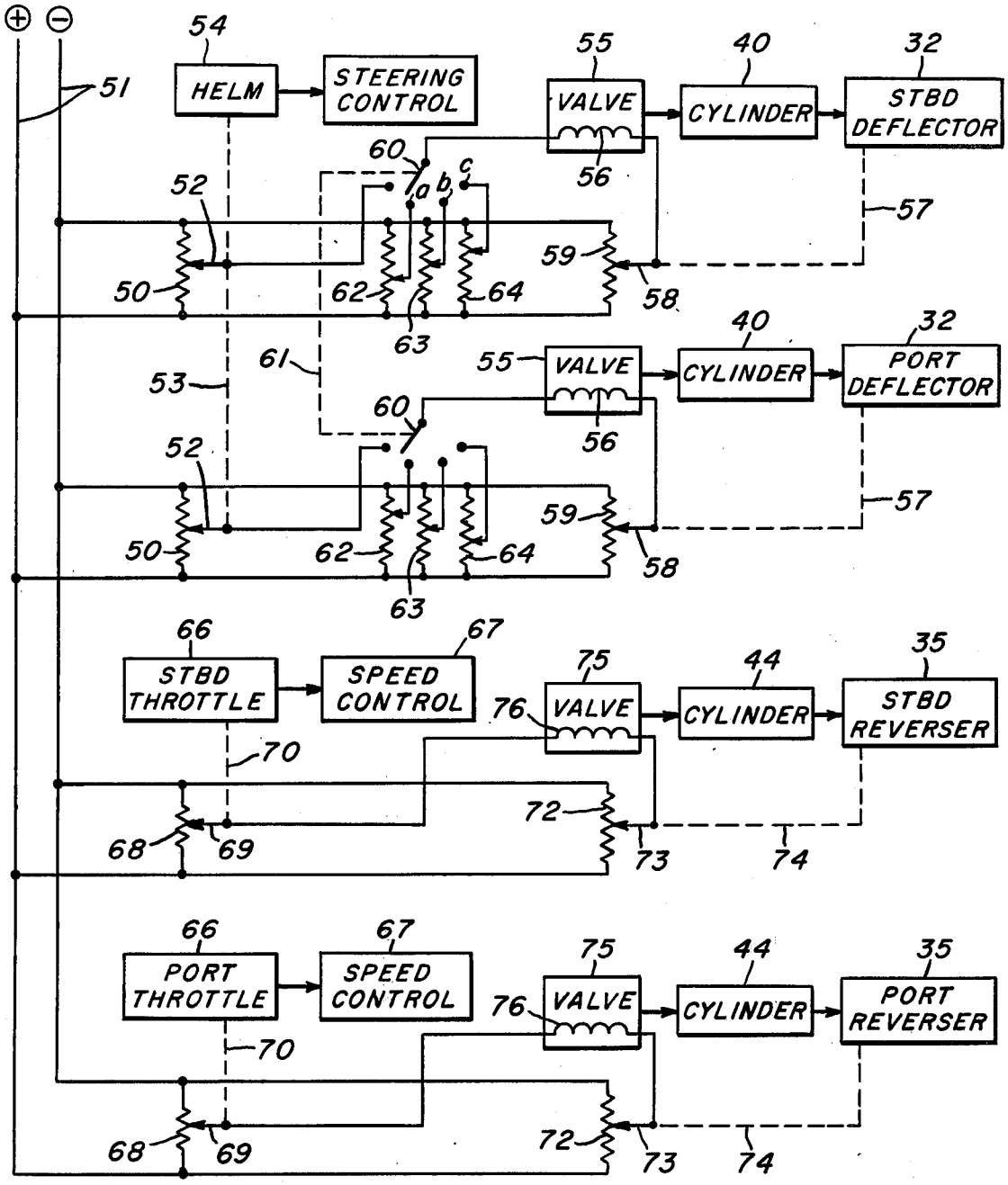
FIG. 9 is a schematic diagram of a control system embodying the invention.

As previously indicated, the invention relates to water-jet propulsion systems for watercraft, and particularly for hydrofoil craft. While the control system of this invention is applicable to any twin-jet propulsion system for any type of watercraft, it is shown in connection with a propulsion system for hydrofoil craft of the type disclosed in Coffey et al. U.S. Pat. No. 3,745,959 and Ashleman U.S. Pat. No. 3,918,256. The system is shown in FIG. 1 applied to a craft having a hull 10 of any suitable type or design with struts 12 pivotally mounted on the hull adjacent the aft end thereof at 14. The struts 12 are connected at their lower ends by a foil system 16 which may include control surfaces and which extends transversely of the craft as shown. The struts 12 are pivotally movable about the pivots 14 to a retracted or horizontal position which may be used when the craft is hull-borne at low speeds if the water is shallow or for other reasons. It will be understood that a similar retractable strut is provided adjacent the bow of the craft which may also be pivotal about a vertical axis for use as a rudder.

The propulsion system includes a water intake structure 18 carried on a center column 20 supported on the foil system 16, a slot 21 being provided in the hull 10 to receive the column 20 when the foils are retracted. The intake structure 18 has an intake opening 22 at its forward end through which water enters under the ram pressure due to forward movement of the craft. Water entering through the port 22 flows through a passage in the column 20 and the stream is divided and directed to the entrances of two centrifugal pumps (not shown) which accelerate the water and discharge it rearwardly through twin-jet nozzles 24. The resulting reaction forces provide the forward propulsive force for the craft. The pumps are preferably driven by individual prime movers of any suitable type controlled by individual throttles. Each of the jet nozzles 24 is also provided with a deflector and thrust reverser assembly 26, the construction and operation of which will be more fully described hereinafter. Reference is made to the above-mentioned Coffey et al patent for a more complete description of the hydrofoil craft and the propulsion system.

In normal operation of the craft, in either hull-borne or foil-borne mode, water is continuously drawn in and is discharged in the two jet streams for propulsion. In addition, the jet streams may be used for steering, or to assist in steering, during hull-borne operation and are maintained in parallel relation to each other with their direction controlled by the helm of the craft, as more fully described hereinafter. In some situations, however, especially in hull-borne operation at low speed, as when maneuvering toward or away from a dock, for example, lateral movement of the craft is frequently desired or necessary, either with or without yaw. Yawing of the craft can be accomplished by means of the jet streams in the manner shown in FIG. 2, in which the propulsion forces due to the jet streams are represented by vectors. As there shown, the vectors A and B, respectively, represent the parallel propulsive forces of the two jet streams deflected at a desired angle from the center line of the craft. In order to yaw the craft, one of the jet streams has been reversed by operation of its thrust reverser bucket as indicated by the direction of the vector A. It will be seen that when the propulsive forces are resolved into their longitudinal and transverse components, there are equal and opposite longitudinal forces on opposite sides of the center line forming a couple which results in yawing the bow of the craft to the port side in FIG. 2. The transverse components of the forces, however, are opposing and substantially equal, so that little or no resultant lateral thrust is produced in this way and the craft merely tends to turn about its center of gravity without substantial lateral movement. Bow thrusters have been used in combination with the reversing of one jet in an attempt to provide lateral maneuverability but as discussed above, this has not been satisfactory, especially in hydrofoils, because of the limitations on the thrust available from the bow thruster as well as the lack of flexibility in maneuvering.

In accordance with the present invention, these difficulties are overcome by removing the jet streams from control by the helm and controlling them in such a manner that lateral force and adequate maneuverability, together with any necessary yaw, are easily obtained. As shown in FIG. 3, this is done by moving the jet streams in opposite directions with respect to the center line so that they are splayed, or placed in divergent angular positions, as indicated by the vectors A′ and B′ in FIG. 3 which again represent the propulsive forces of the respective jet streams. As before, the port jet stream represented by the vector A′ has been reversed, and the components of both propulsive forces are shown. The longitudinal components are again equal and opposite on opposite sides of the center line to produce a turning movement. The lateral components, however, are now both in the same direction so that they are additive, and a resultant lateral thrust occurs tending to move the raft in the lateral direction. Thus, the necessity of a bow thruster is eliminated since substantial lateral thrust is provided by the lateral components of the jet streams themselves. Yaw is produced by the longitudinal components of the propulsive forces which tend to establish a couple, and the rate and direction of yaw can be controlled by the relative magnitudes of the longitudinal and transverse components. This can be controlled by the angle of deflection, or splay angle, of the jets and by the speed of the propulsion pumps.

This is further illustrated in the diagram of FIG. 4. As there shown diagrammatically, and as more fully described below, each jet has associated therewith a deflector 28 and a reverser 29. The deflectors 28 are essentially tubular passages capable of angular movement to change the direction of the jet streams which pass through them, and the reversers 29 are movable reverser buckets for reversing the direction of the jet thrust. In the preferred embodiment of the invention, the reversers are independently controlled and the deflectors are controlled together to move to preset positions. During normal high speed foil-borne operation, the deflectors are maintained parallel to each other and to the center line of the craft. The vertically-pivoted front strut is used as a rudder and steering is accomplished by means of the rudder and other control surfaces under control of the helm. In hull-borne operation, at lower speed, the deflectors may be used for steering under control of the helm but are still kept parallel to each other. Yawing may be accomplished by reversing one of the jets as discussed above. To obtain lateral movement of the craft, however, a lateral force must be applied at or near the center of lateral resistance. In accordance with the invention, such a force is produced by splaying the two jets, and reversing one of them, as explained above. By properly setting the angle of the jets, the resultant lateral force can be applied at the proper point to cause lateral movement only. If some yawing is also desired, the force must be applied slightly forward or aft of the center of lateral resistance. The center of lateral resistance may be regarded as the point at which the resultant of the forces (water, wind, etc.) opposing lateral movement is applied. If an opposing lateral force is applied at this point, therefore, the craft will move laterally only, with no yaw. The point of application of the resultant lateral force is determined by the position of the jets and can be accurately controlled by adjusting the angle of the jets. In this way, lateral movement with no yaw or with yaw in either direction is readily obtained. The speed of the propulsion pumps controls the magnitude of the force and thus the lateral velocity and the rate but not the direction of yaw.

In the preferred embodiment, three preselected positions of the deflectors are provided. In position *a* of FIG. 4, the deflectors 28 are positioned at angles 15° in opposite directions from the center line of the craft. In this position, and with the port jet reversed as shown, the craft will yaw with the bow moving in the direction of lateral motion, that is, to the port side. Position *a* would normally be used when the wind is blowing toward the craft from a docking area which it is approaching, for example, or under similar conditions where it is necessary to hold the craft toward the wind. In the second position *b*, the deflectors are positioned at angles of 18° from the direction of the center line and in this position, lateral motion occurs with substantially no yaw. This position would be used under conditions of little or no wind where only lateral motion is necessary. In the third position *c*, the deflectors are positioned at angles of 21° from the direction of the center line and in this position, the craft tends to yaw in the direction opposite to the lateral motion, that is, the bow moves to the starboard side as seen in FIG. 4. This position would be used, for example, in situations where the wind is blowing toward the docking area. The rate and amount of yaw, in positions *a* and *c*, can be controlled by controlling the speed of the propulsion pumps to vary the magnitude of the turning moment.

The particular angular positions shown in FIG. 4 are, of course, only illustrative and may differ somewhat for different craft and for different configurations. That is, a hydrofoil craft in the hull-borne mode is normally operated with the front foil down and the aft foil retracted. For other configurations such as both foils down, or both foils retracted, greater or smaller angles may be required. This can be provided for in the control system by providing additional preset positions for the deflectors which can be selected by the operator. Thus, in many cases, it will be desirable to provide five positions for the deflectors instead of the three positions shown for illustration. In all cases, a central position (corresponding to *b* in FIG. 4) would be provided in which the yaw is essentially zero. Smaller angles of the jets would cause the bow to move toward the reversed jet while larger angles would cause yaw in the opposite direction. The necessary or desired number of angular positions on each side of the central position is easily provided. It would, of course, be possible to provide for manually adjusting the angles of the deflectors but this is usually unnecessary and it is preferable to provide a reasonable number of preset positions as described, as this greatly facilitates maneuvering the craft.

A deflector and thrust reverser assembly 26 for one jet is shown in FIG. 5. It will be understood that the assembly shown is only illustrative and that any suitable assembly of this general type may be used. One such assembly is associated with each of the two jets 24. As shown in FIG. 5, the assembly 26 is supported on a circular flange 30 bolted to the jet nozzle. The deflector 32 is a generally tubular member which may be of rectangular cross section and is positioned immediately in front of the nozzle 24 so that the jet stream passes through the deflector. The deflector 32 is supported for rotation about a vertical axis by means of brackets 33 on the flange 30 and can be moved angularly about the axis by a lever arm 34 attached to the upper side of the deflector 32.

The thrust reverser 35 consists of a reverser bucket of suitable configuration capable of covering and enclosing the outer end of the deflector 32. When the reverser is in the reversing position, the jet is deflected downwardly and then backwardly through an opening 36 at the bottom of the reverser bucket, thus reversing the direction of the jet thrust. The reverser 35 is supported for rotation about the same axis as the deflector 32 and is normally positioned to one side, as shown in FIG. 5, so that the jet stream is discharged rearwardly through the deflector 32 without obstruction. The reverser 35, however, is angularly movable about the vertical axis by an arm 37 at its upper end to the reversed position. The position of the deflector 32 is controlled by a hydraulic cylinder 40 which is pivotally mounted at 41 on a fixed part of the craft, and which has a retractable piston rod 42 pivotally attached at 43 to the crank arm 34 which moves the deflector. The reverser 35 is controlled by means of a hydraulic cylinder 44 which is pivotally mounted at 45 on the crank arm 34 so as to move therewith. The cylinder 44 has a retractable piston rod 46 which is attached to the arm 37 which operates the reverser 35.

The cylinders 40 and 44 are operated by hydraulic pressure by admitting oil or other hydraulic fluid to one end or the other to move the respective piston rods back and forth. The cylinders are controlled by suitable valve assemblies which are, in turn, electrically controlled by means of the control system described hereinafter. The normal forward position of the assembly is shown in FIG. 5 in which the deflector 32 directs the jet rearwardly of the craft and the reverser 35 is at one side out of the path of the jet. To reverse the jet thrust, the cylinder 44 is operated to move the reverser 35 about its vertical axis to a position which it covers the outlet of the deflector 32, as shown somewhat diagrammatically in FIG. 6. In this position, the jet stream is deflected downwardly and its direction reversed, the water escaping through the opening 36 at the bottom of the deflector. The jet thrust is thus reversed.

The angular positioning of the deflector 32 is illustrated somewhat diagrammatically in FIGS. 7 and 8. Thus, in FIG. 7 which corresponds generally to the position of FIG. 5, the deflector 32 is in a position essentially aligned with the jet nozzle 24 and the reverser 35 is at one side out of the path of the jet stream. The deflector is movable angularly about its vertical axis by operation of the cylinder 40 to a position such as shown in FIG. 8, for example, where the direction of the jet stream and thus of the propulsive force has been changed. Because of the mounting of the cylinder 44 on the crank arm 34, the cylinder 44 and reverser 35 move with the deflector so that the reverser remains out of the path of the jet stream. If it is desired to reverse the jet thrust in any position of the deflector, however this is done by operating the cylinder 44 to rotate the reverser about its axis to the reverse position with respect to the deflector. Thus, the deflector and reverser can be independently controlled and the deflector can be moved to any angular position for operation with either forward or reverse thrust. It will be understood that any suitable type of deflector and thrust reverser mechanism may be used in place of the specific mechanism shown for illustration.

A simplified diagram of a preferred control system is shown in FIG. 9. As there shown, and as described above, the port and starboard deflectors 32 and the port and starboard reversers 35 are separately operated and each has its own control circuit.

The two deflectors 32 have individual control circuits which may be identical except as noted below. In each case, a potentiometer 50 is provided connected across a source of direct current potential, indicated at 51, and provided with a movable contact 52. The contacts 52 of both potentiometers 50 are connected to move together in any suitable manner, as by a mechanical linkage indicated at 53 which is connected to the helm 54. The helm 54 is operated by the pilot and actuates any suitable type of steering control system such as that shown, for example, in Stark et al. U.S. Pat. No. 3,886,884 which positions the rudder and other control surfaces of the craft in response to commands from the helm. The deflectors 32 are also controlled by the helm during normal operation of the craft by means of the linkage 53. As indicated above, each deflector 32 is operated by a cylinder 40 under the control of a valve system 55 which may be of any suitable type and which is electrically actuated by a solenoid 56. Each deflector 32 is provided with a mechanical transducer, or position indicator, represented by a mechanical connection 57 to a movable contact 58 on a fixed resistor 59 connected across the direct current source 51.

A four-position control switch 60 is provided for each deflector having four contact points as shown. The switches 60 may be connected for ganged operation, as indicated at 61, or they might be replaced by a single switch of sny suitable type having dual sets of contacts. Each movable contact 52 is connected to one of the contact points of the corresponding switch 60 and the switch is connected to the solenoid 56 which is also connected to the contact 58 on the resistor 59. Three fixed resistors 62, 63 and 64 are also provided and connected in parallel across the direct current source 51. The resistors 62, 63 and 64 control movement of the deflector to one of three preset positions corresponding to the positions *a*, *b* and *c* of FIG. 4. For this purpose, the resistor 62 has a tap connected to a second contact of the switch 60 for position *a*, the resistor 63 has a tap connected to a third contact for position *b*, and the resistor 64 has a tap connected to the fourth contact for position *c* of FIG. 4.

In the operation of this control circuit, if the switch 60 is on the left-hand contact, for example, so that the movable contact 52 is connected to the solenoid 56, the voltage of potentiometer 50 at the contact 52 is applied to the solenoid 56 in opposition to the voltage of resistor 59 at contact 58. The voltage across the solenoid 56 is thus the difference of these two voltages and, if it differs from zero, will energize the solenoid to actuate the valve 55. This causes the cylinder 40 to move the deflector 32 in one direction or the other, depending on the direction of the voltage. The contact 58 of the transducer 57 is correspondingly moved until it reaches a point on the resistor 59 where the voltage balances that of potentiometer 50. At this point, the voltage across the solenoid 56 becomes zero and the deflector stops in that position. It will be seen, therefore, that the deflector 32 can be moved by moving the contact 52 in one direction or the other, and such movement will cause a corresponding movement of the deflector until the voltage at contact 58 balances the voltage at contact 52.

In normal forward operation, the switches 60 are on the left-hand contacts and both movable contacts 52 are moved together in response to the helm 54. The two deflectors 32 are thus electrically locked together and maintained in parallel relation, and they can be simultaneously moved to change their angular position as described above. For lateral maneuvering of the craft, the switches 60 are moved to one of the other three positions which correspond to the positions *a*, *b* and *c* of FIG. 4, respectively. This interrupts control of the deflectors by the helm and causes the two deflectors to move to one of the preset fixed positions determined by the taps on the three fixed resistors 62, 63 and 64. The taps on these resistors are located to position the deflectors in the exact angular positions required to cause the desired direction of yaw, and to cause the deflectors to move in opposite directions to the desired angularly divergent positions. Operation of the switch 60 thus takes the deflectors away from the helm control and moves them to a selected one of the preset angular positions. It will be understood that five or more present positions may be provided if necessary as previously discussed. This is readily done by providing additional fixed resistors with appropriate voltage taps.

The reversers 35 are independently operated and may be controlled in any suitable manner. There is shown in FIG. 9 a reverser control system of the type which is fully disclosed in the above-mentioned Ashleman patent, to which reference may be made for a more complete description. Each of the reversers 35 is controlled by a throttle 66 which also controls the speed of the associated propulsion pump as indicated at 67. A potentiometer 68 with a movable contact 69 is connected across the direct current potential 51, and the contact 69 is mechanically connected to the throttle 66 to be moved thereby, as indicated by the connection 70. A fixed resistor 72 is also connected across the direct current source and has a movable contact 73 which is connected to the reverser 35 by a mechanical linkage, indicated at 74, to form a position transducer for the reverser. A valve mechanism 75 of any suitable type is provided to control the hydraulic cylinder 44 which operates the reverser 35 in the manner previously described. The valve mechanism 75 is actuated by a solenoid 76 which is connected between the movable tap 69 and the movable contact 73 so that the solenoid 76 is energized by the voltage difference between the contacts 69 and 73. Movement of the contact 69 by the throttle 66, therefore, causes the reverser 35 to move until the contact 73 reaches a corresponding position. As more fully described in the Ashleman patent, the arrangement of the potentiometer 68 and of the speed control system 67 is such that the tap 69 can be moved throughout the central portion of the potentiometer 68 while the speed control remains at idling speed. The reverser 35 moves correspondingly from the full-forward position at one end of this movement to the full-reverse position at the other end. Further movement of the throttle beyond either of these points results in increasing the speed of the propulsion pump while the reverser remains in its forward or reverse position. An exactly similar control is provided for the other reverser so that they can be independently operated to any desired position or speed.

It will now be seen that a control system is provided which makes possible greatly improved lateral maneuvering of a water-jet propelled watercraft. This is readily accomplished by the control system shown in which the deflectors may be used for steering in the conventional manner during normal operation. For lateral maneuvering, however, they are disconnected from control by the helm and moved to one of a number of preset positions in which the deflectors are spalyed or angularly divergent at accurately determined angles from the center line. If one of the jets is then reversed by operation of its reverser bucket, a lateral thrust results which tends to move the craft laterally in the direction of the reversed jet, with a desired yaw, or no yaw, as determined by the angle of the jets, and at a yaw rate and amount which can be easily controlled by the relative speed of the propulsion pumps. In this way, a very effective maneuvering capability is obtained which cannot be obtained by the conventional bow thruster arrangement, and which makes it possible to provide as large a lateral thrust as necessary, with sufficient yaw in either direction, to control the craft in any wind or current conditions. The system is easily controlled by means of a simple multi-position switch together with the throttles, without requiring any special equipment or unusual skill. An important improvement in the maneuverability and handling capability of water-jet propelled craft and especially hydrofoils is thus provided.

I claim as my invention:

1. In a watercraft having a propulsion system including two generally parallel water jets directed rearwardly of the craft, each of said jets having associated therewith deflector means for controlling the angular direction of the jet and thrust reverser means for reversing the direction of the jet thrust, control means for said deflector means for normally maintaining the jets parallel to each other and for moving both deflectors means together to simultaneously change the direction of the jets, said control means also including means for moving the deflector means in opposite directions to divergent positions such that the jets diverge at equal angles relative to the center line of the craft, and control means for independently positioning each of said thrust reverser means, whereby the thrust of one of the jets may be reverser means, whereby the thrust of one of the jets may be reversed while the jets are in said divergent position to effect lateral movement of the craft.

2. The combination defined in claim 1 in which said deflector control means moves the deflector means to a preset divergent angular position.

3. The combination defined in claim 1 in which said deflector control means moves the deflector means to a selected one of a plurality of preset divergent angular positions.

4. The combination defined in claim 1 in which said deflector means for each jet comprises a generally tubular member through which the jet passes, said member being movable about a vertical axis to change the angular position of the jet.

5. The combination defined in claim 4 including control means for moving said tubular members to any one of a plurality of preset divergent angular positions.

6. The combination defined in claim 4 including helm means for steering said craft, said helm means including means for moving said tubular deflector members together to maintain said jets in a substantially parallel position, and said control means including means for interrupting control of the deflector members by the helm means and for moving said members in opposite directions to a selected one of a plurality of preset angular positions.

7. The combination of claim 4 in which the thrust reverser associated with each jet comprises a reverser bucket movable about the same vertical axis as the deflector member, said reverser bucket being movable with the deflector member and being independently movale relative thereto between a forward position and a reverse position.

8. The combination of claim 7 including control means for moving the deflector means of both jets in opposite directions to a selected one of a plurality of preset divergent angular positions, and independent control means for each reverser bucket for moving the reverser bucket between forward and reverse positions.

* * * * *